United States Patent [19]

Berchem et al.

[11] Patent Number: 4,676,014

[45] Date of Patent: Jun. 30, 1987

[54] EXCAVATOR TOOTH

[75] Inventors: Rütger Berchem, Gelsenkirchen; Georg Proschka, Recklinghausen, both of Fed. Rep. of Germany

[73] Assignee: Berchem & Schaberg GmbH, Gelsenkirchen, Fed. Rep. of Germany

[21] Appl. No.: 821,997

[22] Filed: Jan. 24, 1986

[30] Foreign Application Priority Data

Jan. 24, 1985 [DE] Fed. Rep. of Germany ..... 3502250

[51] Int. Cl.[4] ..... E02F 9/28

[52] U.S. Cl. ..... 37/142 R; 172/762

[58] Field of Search ..... 172/713, 762, 753; 37/142 R, 141 T, 142 A; 403/13, 155, 324, 326; 299/92

[56] References Cited

U.S. PATENT DOCUMENTS

| | | | |
|---|---|---|---|
| 943,775 | 12/1909 | Exton | 37/142 R |
| 1,584,052 | 5/1926 | Van Buskirk | 37/142 R |
| 1,780,397 | 11/1930 | McKee | 37/142 R |
| 3,188,756 | 6/1965 | Baer | 172/762 X |
| 3,453,755 | 7/1969 | Trudeau | 37/142 R |
| 3,574,962 | 4/1971 | Smith | 172/713 |
| 3,751,834 | 8/1973 | Petersen | 37/142 R |
| 4,367,602 | 1/1983 | Petersen | 37/142 A |
| 4,505,058 | 3/1985 | Peterson | 37/142 A |

FOREIGN PATENT DOCUMENTS

| | | | |
|---|---|---|---|
| 248497 | 11/1960 | Australia | 37/141 T |

*Primary Examiner*—Richard J. Johnson

*Attorney, Agent, or Firm*—Karl F. Ross; Herbert Dubno

[57] ABSTRACT

A cutter for an excavator or like earth moving machine or implement has a holder which can be mounted on the machining bucket and formed with a bifurcated end receiving a web between claws of a replaceable tooth. The web projects beyond the cover claws and the channel between the coupling claws of the holder is formed with the pocket into which a fastening element can be inserted so that shanks of this element are received in grooves of the web within the pocket and the tooth is thereby braced against the holder.

3 Claims, 4 Drawing Figures

EXCAVATOR TOOTH

CROSS REFERENCE TO RELATED APPLICATION

This application is related to the commonly assigned copending application Ser. No. 701,580 filed Feb. 14, 1985.

FIELD OF THE INVENTION

My present invention relates to an excavator tooth and, more particularly, to a cutter for a bucket, scoop, wheel, belt, boom or arm excavator and, more particularly, to a two-part cutter in which a tooth is removably held in a holder by a connecting device, especially for bucket or conveyor or wheel excavators.

BACKGROUND OF THE INVENTION

Two-part cutters for bucket and wheel excavators, which are formed with teeth which cut into the ground, can have a tooth which can be removably affixed in a holder, the latter being mounted in turn, e.g. by welding, to the support which can be a bucket or scoop.

The connecting means may include a claw coupling in which, for example, a pair of claw like arms spaced apart on the holder to form a bifurcation, straddle a web or shank of the tooth. These two arms or cheeks may be referred to hereinafter as the coupling claws of the holder.

The cutting tooth can be provided with the aforementioned web or shank receivable between the coupling claws of the holder and thereby forming a counter claw, as well as a pair of cover claws lying above and below the coupling claws of the holder and bridged by this web.

The counter claw, web or shank can be locked in place within the holder by a fastener.

When the cutter holder is welded or otherwise connected to the bucket or other support of a bucket or wheel excavator, the tooth may be replaced upon removal of the fastener and thus may constitute a wearable element which can be exchanged quickly and simply.

In the past, the fastener has generally been a pin and the counter claw or web was coterminous with the cover claws of the cutter. In place of a pin, a rolled compression sleeve could also be used, the pin or sleeve being inserted through aligned bores traversing the coupling claws of the holder, i.e. the cheeks thereof, as well as the counter claw or web.

Since the tooth undergoes considerable abrasive wear, especially along the lateral flanks which were provided with the pin or sleeve, deformation could occur which made it difficult to replace the tooth or allow the tooth to loosen by itself.

Tooth-replacement problems were especially the case in excavators in which the number of teeth and hence tooth holders was comparatively large and thus the tooth holders had to be fastened with a minimum distance from one another. This complicated removal, especially where the pins were inserted in the direction in which the row of teeth extended. In this case it was particularly difficult to mount or remove a tooth or even obtain access to the pin.

OBJECTS OF THE INVENTION

It is, therefore, the principal object of the present invention to provide an improved cutter excavator, of the type which comprises a holder and a removable tooth, which will render the fastening device more reliable and less susceptible to damage upon use.

Another object of my invention is to overcome the drawbacks of earlier cutter attachment arrangements for bucket and wheel excavators and the like.

Still another object of my invention is to facilitate replacement or exchange of the teeth of cutters for the purposes described, especially where these cutters are mounted with close spacing in a row.

SUMMARY OF THE INVENTION

These objects and others which will become apparent hereinafter are attained, in accordance with the present invention, in a cutter of the type described but wherein the counter claw of the tooth, i.e. the web is formed with a free end projecting beyond the cover claws and is provided with a formation shaped so that it is accommodated in a pocket formed between the coupling claws of the holder and which is open in a direction transverse to the row of cutters, i.e. parallel to the plane of the web or counter claw of the removable tooth. At least one fastening element is insertable between this formation and the pocket to prevent removal of the tooth from the holder when that element is in place.

Preferably the formation comprises a pair of opposite locking grooves, i.e. grooves formed on opposite faces of the web, while the pocket has shoulders turned toward these grooves and engaged by the shank of each fastening element when the latter is inserted into a respective groove.

The fastening element can be a U-shaped member whose shanks or arms can be received in the respective grooves and project therefrom over the width of the formation with ends of the shanks bendable about the web to retain the element in place.

Alternatively, a pair of pins can have opposite ends which can be bent inwardly around the web to retain them in place so that two such pins form shanks of the fastening element flanking the web.

By appropriately dimensioning the grooves of the pocket and the shoulders, a wedge like interfitting of the two parts can be ensured. This wedging action is facilitated and the entire assembly held under prestress when the holding claws of the holder converge or are tapered toward the tip of the tooth and the cover claws of the tooth similarly converge to hold the holding claws of the holders between them, i.e. a wedge-like interfitting of the covered claws and the holding claws is ensured.

With this structure of the invention, the tooth of the holder may be subjected to wear, but such wear does not usually obstruct access from above the row of the cover to the pins or U-shaped elements which can therefore be readily extracted to release the teeth and allow replacement. Any difficulties can be eliminated further by the fact that one can readily burn away the fastening element and the formation in the pocket if there should be any difficulty with removal of the tooth. One need not have access in the direction of the row.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 2:
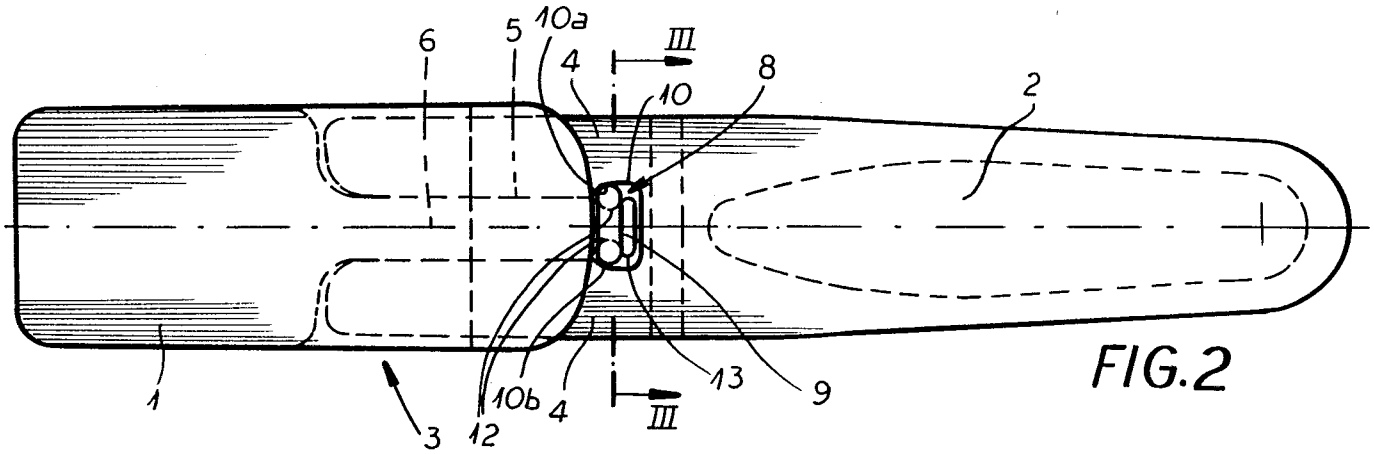
FIG. 2 is a plan view of the cutter of FIG. 1.

The cutter shown in the drawing is particularly suitable for use with excavator buckets, bucket wheels and the like, and basically comprises a cutter tooth 1, a tooth holder 2 and a connecting arrangement 3 securing the tooth 1 to the holder 2 with practically no play.

The connecting arrangement is a claw coupling and, for this purpose, the holder 2 is formed with a bifurcated end defining a pair of opposing coupling claws 4 forming between them a gap or channel 5 dimensioned to receive snugly a web or counter claw 6 formed on the tooth 1.

The web 6 lies orthogonal to a pair of covered claws 7 converging in the direction of the tip of the tooth and defining between them laterally open compartments in which the wedge-shaped coupling claws 4 are complementarily received.

Figure 1:
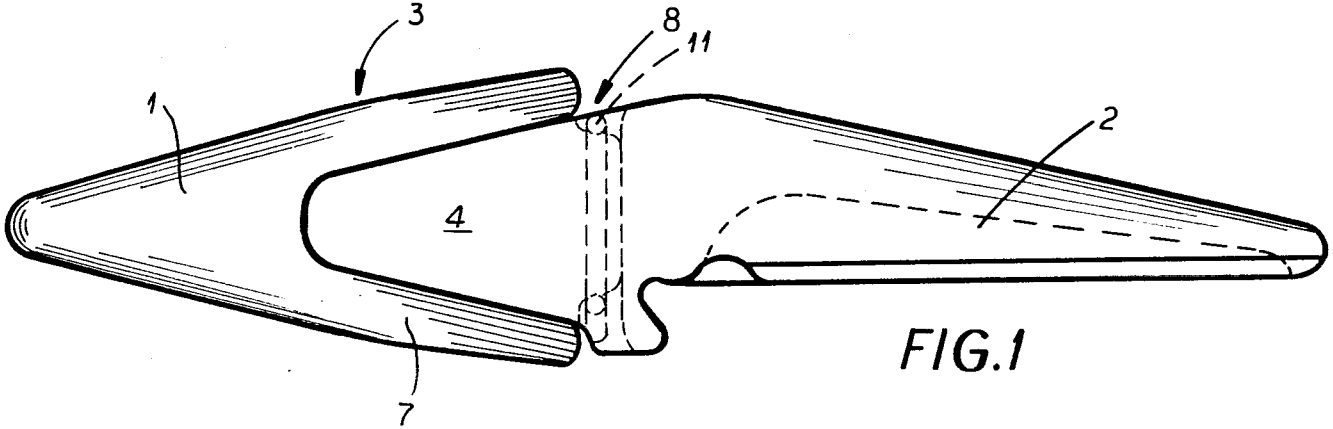
FIG. 1 is a side elevational view of a cutter according to the invention.

As is also clear from FIGS. 1 and 2, a free end of the web 6 projects beyond the cover claws 7 and is provided with a formation represented at 9 which is received in a complementary pocket 10 at the base of the recess 5.

The formation 9, a pair of shoulders 10*a* and 10*b* of the pocket 10, and a fastening element 11 constitute a locking device 8 which removably retains the tooth 1 on the holders 2.

The formation 9 has a pair of oppositely opening locking grooves 12 which form a neck defining a head 13 at the free end of the formation 9 which is pressed to the right (FIGS. 1 and 2) when the shanks 14 of the hairpin-shaped or U-shaped fastening element 11 are drawn into the grooves 12 between the head 13 and the shoulders 10*a* and 10*b* of the pocket.

Figure 3:
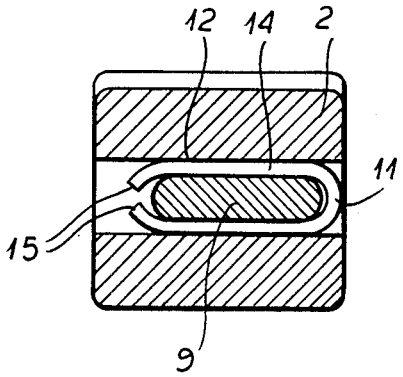
FIG. 3 is a cross section taken along the line III—III of FIG. 2.

The free ends of the shanks 14 can be bent inwardly as has been shown at 15 at FIG. 3 to hold the fastening element 11 in place. The ends 15 thus project beyond the width of the formation 9.

Figure 4:
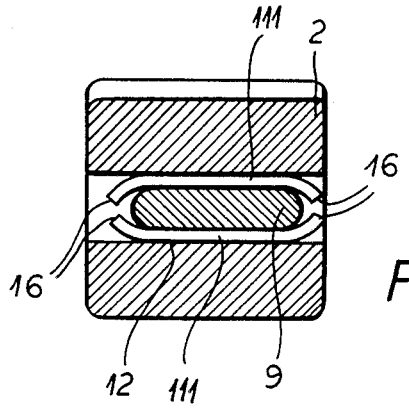
FIG. 4 is a view similar to FIG. 3 but illustrating another embodiment of the invention.

As can be seen from FIG. 4, individual locking elements 111 can be provided in the form of pins whose opposite ends 16 project beyond the width of the web 9 and thus can be bent inwardly to hold them in place.

The fastening device 8 not only allows separation and replacement of the tooth with wear, but extraction of the lock element or locking elements, but it also functions as a prestressing arrangement which causes the claws 4 to wedge between the claws 7 under the stress with which the head 13 is pressed to the right (FIGS. 1 and 2).

The cutter tooth is preferably formed as described in the aforementioned copending application.

I claim:

1. A cutter for an excavator which comprises:

a holder adapted to be affixed to a support bucket or the like of an excavator and formed with a bifurcation defining a pair of coupling claws having a channel between them;

a replaceable tooth removably mountable on said holder and provided with a web receivable in said channel and disposed between a pair of cover claws straddling said coupling claws, said web having a formation projecting beyond said cover claws, said channel being provided at a base thereof with a pocket receiving said formation;

at least one fastening element received in said pocket and braced against said formation for retaining the claws of said tooth and said holder in mutually interfitting relationship, thereby releasably retaining said tooth on said holder; and said formation comprising a pair of oppositely open grooves formed on said web, said pocket being provided with a pair of shoulders adjacent said grooves, said fastening element having a U-shaped pair of shanks whose entire length is received in said grooves and braced against said shoulders, and said shanks having free ends projecting beyond said web bent inwardly toward one another around said web.

2. The cutter defined in claim 1 wherein said shanks are shanks of a U-shaped bent spring wire.

3. The cutter defined in claim 1 wherein said cover claws converge toward a tip of said tooth and said coupling claws converge toward said tip of said tooth whereby said claws are wedged together upon seating of said element in said pocket.

* * * * *